United States Patent [19]

Van Gompel

[11] 4,075,877

[45] Feb. 28, 1978

[54] LOCK ASSEMBLY

[75] Inventor: James Van Gompel, Fremont, Ind.

[73] Assignee: Brammall, Inc., Angola, Ind.

[21] Appl. No.: 757,655

[22] Filed: Jan. 7, 1977

[51] Int. Cl.[2] ..... E05B 15/16; E05B 35/04; E05B 67/06; E00B 67/36

[52] U.S. Cl. ..... 70/34; 70/49; 70/387; 70/417

[58] Field of Search ..... 70/49, 15, 30, 93, 34, 70/352, 388, 387, 417, 401

[56] References Cited

U.S. PATENT DOCUMENTS

| | | | |
|---|---|---|---|
| 200,990 | 3/1878 | Deraismes | 70/49 |
| 1,576,071 | 3/1926 | Setterberg | 70/49 |
| 1,890,744 | 12/1932 | Noonan | 70/34 |
| 1,917,778 | 7/1933 | Smith | 70/388 |
| 1,929,235 | 10/1933 | Bevington | 70/401 |
| 3,637,180 | 1/1972 | Parry | 70/387 |
| 3,768,284 | 10/1973 | Kent | 70/417 |

FOREIGN PATENT DOCUMENTS

| | | | |
|---|---|---|---|
| 680,416 | 8/1939 | Germany | 70/401 |
| 425,009 | 2/1926 | Germany | 70/34 |
| 255,889 | 7/1911 | Germany | 70/34 |
| 745,101 | 2/1956 | United Kingdom | 70/49 |

*Primary Examiner*—Robert L. Wolfe
*Attorney, Agent, or Firm*—Hill, Gross, Simpson, Van Santen, Steadman, Chiara & Simpson

[57] ABSTRACT

A lock assembly is provided for securing ends of a chain. One end of the chain is secured to a locking post while the other end is secured to a locking cap. The locking post has a longitudinal bore and a plurality of circular ribs near one end of the post. A plurality of open-ended longitudinal slots are provided which intersect the ribs. The locking cap has a plurality of spring biased locking rings positioned within the cap. To lock the assembly, the end of the lockng post with the ribs is inserted into the locking cap until the ribs engage the locking rings. A spring loaded piston is provided in the longitudinal bore of the locking post to keep the interior of the post free from dirt and ice and also to assist in unlocking the assembly. A key having a plurality of radially spaced fins is utilized to unlock the assembly by inserting the key into the locking cap such that the fins slide within the slots of the locking post until they contact and deflect the locking rings to release the same from the ribs of the locking post.

13 Claims, 11 Drawing Figures

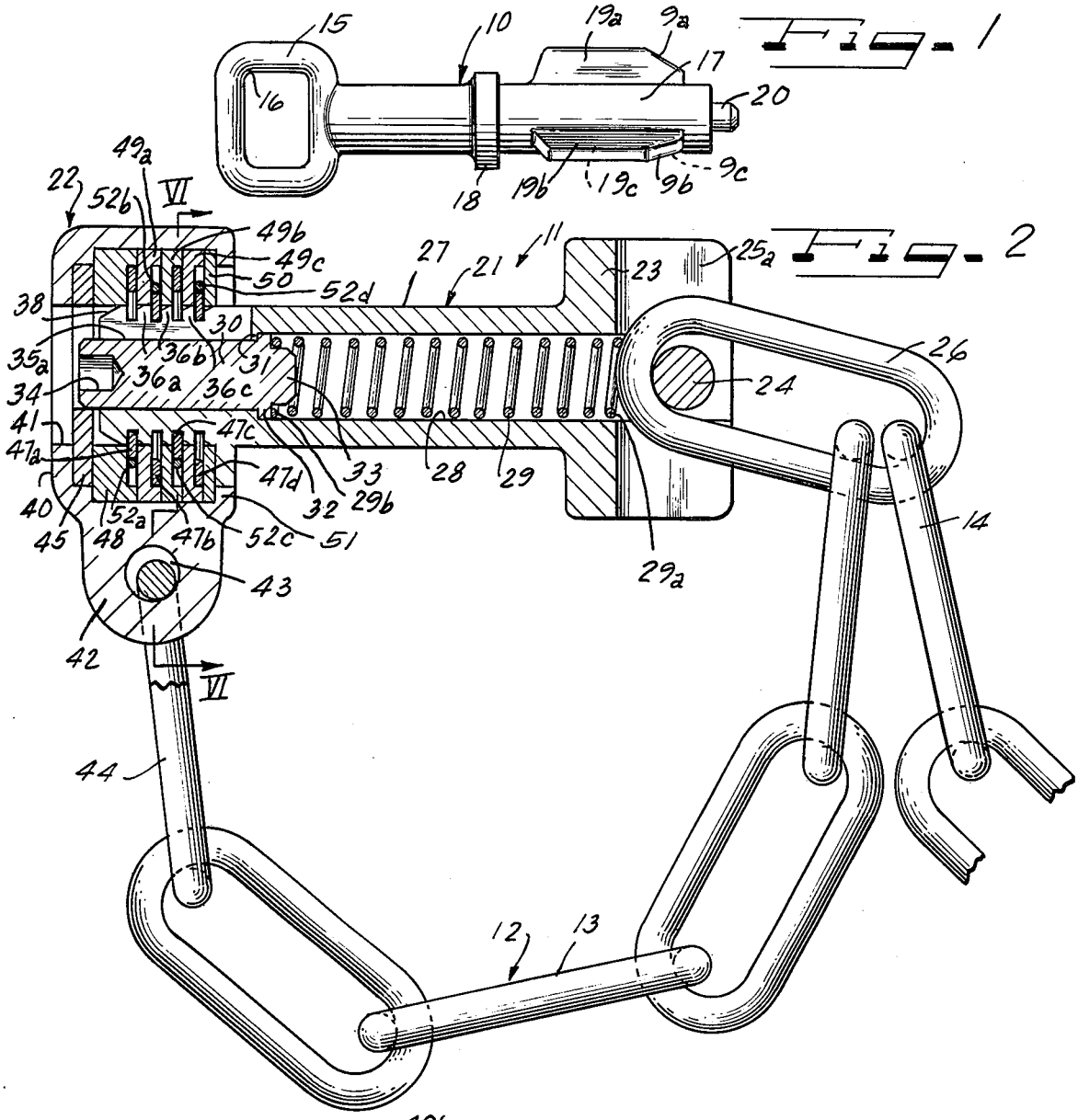
Fig. 1
Fig. 2
15
10
19a
9a
17
20
16
18
19b
19c
9b
9c
22
52b
49a
VI
49b
49c
50
52d
27
21
11
23
25a
38
30
35a
36b
31
36a
36c
34
41
47c
47a
47d
33
28
29
32
29b
40
52a
45
48
47b
52c
51
29a
26
24
14
43
42
VI
44
12
13
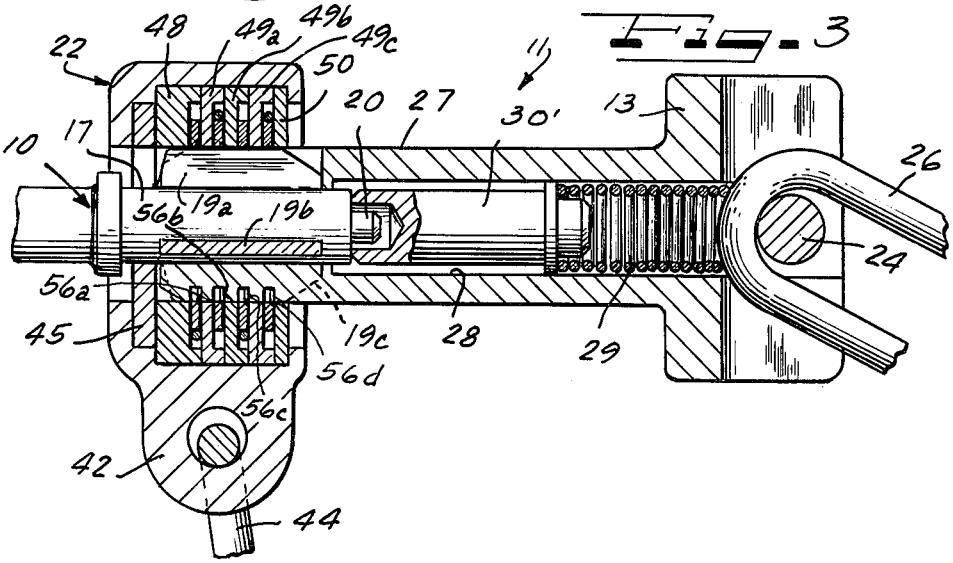
Fig. 3
48
49a
49b
49c
22
50
11
20
27
30'
13
10
17
26
56b
19a
19b
24
56a
45
19c
28
29
56d
56c
42
44

Fig. 4A
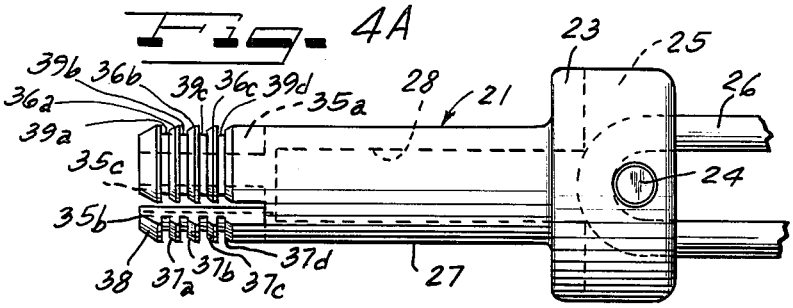
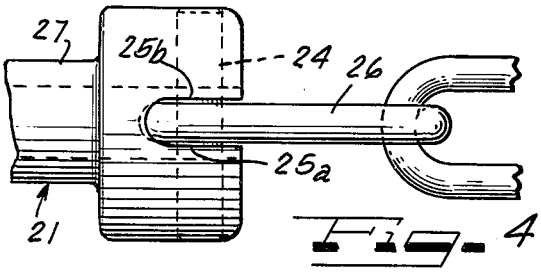
Fig. 4B
Fig. 5
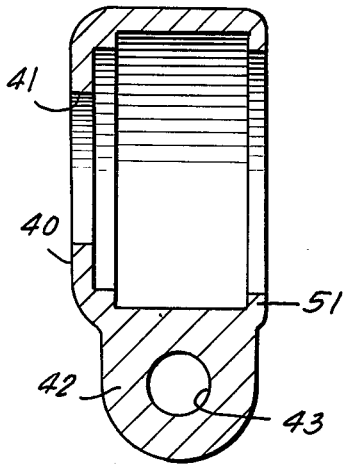
Fig. 6
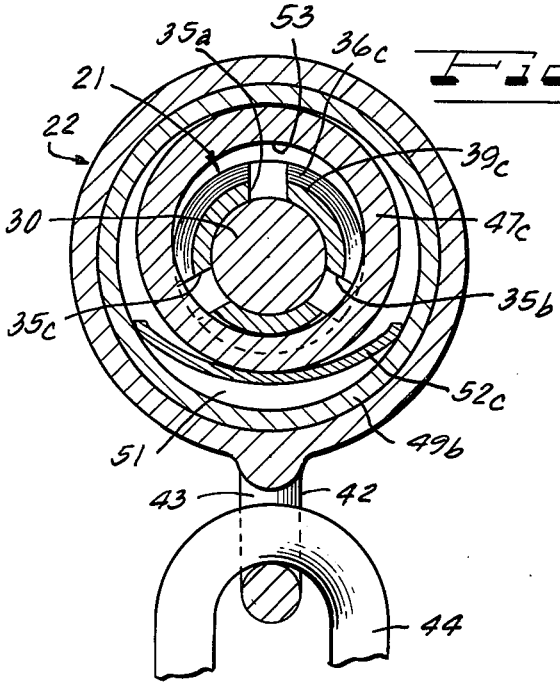
Fig. 7
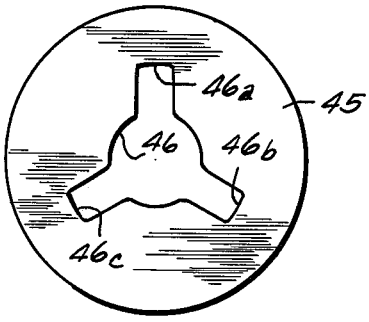
Fig. 8A
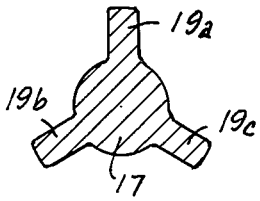
Fig. 8B
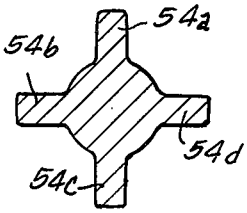
Fig. 8C
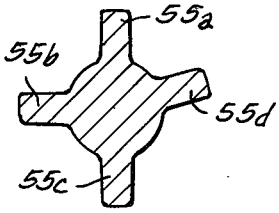

LOCK ASSEMBLY

BACKGROUND OF THE INVENTION

1. Field of the Invention

This invention relates to a locking assembly and more particularly to a locking assembly for joining ends of a security device such as a chain.

2. Description of the Prior Art

In the railroad industry, tampering with rail line switches has become a serious problem. It is desirable that the switches be locked in position with a lock assembly which can be conveniently operated by keys of simple manufacture.

Exposure to rain, snow, and ice renders many types of prior art assemblies unsuitable for the above application. If ice collects within the lock assembly, the lock may become inoperable. Furthermore, lock assemblies of the prior art which are protected from the elements are both costly and difficult to operate.

SUMMARY OF THE INVENTION

It is an object of this invention to provide a lock assembly which is simple to manufacture, inexpensive, easy to operate, and is protected from contamination by snow, dirt or ice.

It is another object of this invention to provide a lock assembly in which a key used with the assembly may be easily coded to provide a large selection of keys.

It is a further object of this invention to provide a lock assembly which can be unlocked by use of only one hand and wherein a locking cap portion of the locking assembly remains on the key after unlocking.

According to the invention, the lock assembly has a locking post and a locking cap receivable over an end of the post. The other end of the locking post is secured to an end of a security device such as a chain. The post is provided with a longitudinal bore and at least one rib transverse to the longitudinal axis and near the end of the post. At least one longitudinal slot is also provided which intersects at least one rib.

A key aperture in the locking cap is provided together with locking means positioned in the locking cap which are spring biased so as to engage the rib of the locking post when the cap is received over the end of the locking post. To unlock the assembly, a key having a shank portion with a release means thereon is inserted into the locking cap. The release means moves the locking means away from engagement with at least one rib by action through the locking post longitudinal slot.

BRIEF DESCRIPTION OF THE DRAWINGS

FIG. 1 is a plan view of the key used to unlock the locking assembly of this invention;

FIG. 2 is a cross-sectional view of the locking assembly of this invention;

FIG. 3 is a cross-sectional view of the locking assembly of FIG. 2 with the key of FIG. 1 inserted;

FIG. 4A is a plan view of a locking post of the locking assembly of FIG. 2;

FIG. 4B is a fragmentary side view of a securing portion of the locking post of FIG. 4A;

FIG. 5 is a plan view of a cap body of a locking cap of the locking assembly of FIG. 2;

FIG. 6 is a cross-sectional view taken along line IV—IV of FIG. 2;

FIG. 7 is a plan view of a key selector plate in the locking cap of FIG. 2;

FIG. 8A is a cross-sectional view taken along line VIII—VIII of the key of FIG. 1; and FIGS. 8B and 8C are alternate embodiments of FIG. 8A.

DESCRIPTION OF THE PREFERRED EMBODIMENTS

A key generally illustrated at 10 and a lock generally illustrated at 11 in FIGS. 1 and 2 comprise the lock assembly of this invention. A security device such as a chain 12 has a link 26 connected to a locking post 21 and a link 44 connected to a locking cap 22 received over an end of the locking post 21. The portion 13 of this chain between the links 26 and 44 may be used to secure a railroad switch, for example. A tiedown portion 14 of the chain may be staked to a railroad tie to prevent unauthorized removal of the lock assembly.

The lock key 10 shown in FIG. 1 has a finger grip 15 with an aperture 16 therein. A shank 17 of the key has a stopper 18 and radially spaced fins 19*a,b,c,* surrounding the shank 17 below the stopper 18. A beveled edge 9*a,b,c,* is provided on each of the fins. A guide member or pin 20 protrudes from an end of the shank 17.

As shown in FIG. 2, the locking cap 22 is received and locked to an end of the locking post 21. Referring to FIGS. 2, 3, 4A and 4B, a securing portion 23 can be seen at one end of the locking post 21. This securing portion has upper and lower surfaces 25*a,b* with a retaining pin 24 mounted therebetween. The chain link 26 is retained by the pin 24 in such a position that a central, longitudinal bore 28 through a post member 27 of the locking post has its one end enclosed by an end portion of the chain link 26. An injector spring 29 is provided in the bore 28 such that an end 29*a* of the spring is biased against the link 26. The other end 29*b* of the spring 29 is biased against an ejector pin or piston 30 movable within the bore 28. A narrowed portion 31 within the bore 28 serves as a stop against which a shoulder 32 on the ejector pin 30 is biased by the action of the spring 29. A protruding portion 33 at the end of the ejector pin 30 centers the end 29*b* of the spring 29 against the ejector pin 30. At the other end of the ejector pin 30 an aperture 34 is provided for mating with the guide member 20 of the lock key 10 shown in FIG. 1.

FIG. 3 illustrates the position of the ejector pin during a compressed position 30' when the key 10 is inserted in the lock.

As shown most clearly in FIG. 4A, three longitudinal slots 35*a,b,c* are arranged around the post member 27 at the key insertion end of the locking post 21. These slots correspond in position to fins 19*a,b,c* of key 10. These slots extend as far as the narrowed portion 31 within the bore 28 of the post member 27.

Annular recesses 39*a,b,c,d* at the key insertion end of the post member 27 form circular ribs 36*a,b,c*. The periphery of these ribs is chamfered at 37*a,b,c* together with a chamfered edge 37*d* adjacent the recess 39*d*. A leading chamfered edge 38 at the front of the key insertion end of the post member 27 is also provided.

Referring now to FIGS. 2 and 5, the locking cap 22 is illustrated having a cup-shaped circular body portion 40. A key entry aperture 41 is provided at a key insertion end of the locking cap. A protruding lobe 42 having an aperture 43 connects to a chain link 44. A key selector plate 45 is mounted in the cap body 40 adjacent the key entry aperture 41. This key selector plate is shown isolated in FIG. 7. An aperture 46 together with slots 46*a,b,c* is provided in the key selector plate 45 such that they correspond to the positioning of fins 19*a,b,c* on key 10 and slots 35*a,b,c* in post member 27.

As shown in FIGS. 2 and 6, spring bias locking rings 47*a,b,c,d* are positioned within the body portion 40 of the locking cap 22 by a locator member 48. These locking rings are further held in position by housing or spacing members 49*a,b,c* having annular grooves within which the locking rings are seated. A cover member 50 retains the housing members and locator member within the body portion 40 when a circular flange 51 is bent over against the cover member 50. The locking rings 47*a,b,c,d* may be either flat or round. Springs 52*a,b,c,d* bias these locking rings in an offset manner. In place of springs 52*a,b,c,d* split rings with a built-in tension may also be employed. Aperture 53 (see FIG. 6) formed within the center of the locking rings is preferably larger than the diameter of the recesses 39*a,b,c,* and approximately the same dimension as the diameter of the ribs 36*a,b,c.*

Chamfered edges 56*a,b,c,d* illustrated most clearly in FIG. 3 may be formed on the outer peripheral edges of the locking rings 47*a,b,c,d.* Such edges may be provided in combination with chamfered edges 37*a,b,c,d* on the post ribs 36*a,b,c* or may be employed in place of chamfered edges on the post ribs. This permits locking without a key by simply pushing the locking cap onto the locking post.

As shown in FIGS. 8A,B,C, coding of the keys 10 is accomplished by various placements of the fins 19*a,b,c* about the shank 17. As illustrated, fewer or more fins may be employed at various angles to obtain different codings. The 90° placement of fins 54*a,b,c,d* in FIG. 8B or the offset of one fin 55*d* as compared to other fins 55*a,b,c* as shown in FIG. 8C may be employed. It should be noted that the slots in the key selector plate 45 and slots in the post member 27 must match the fin placement of the key 10.

OPERATION OF THE LOCK ASSEMBLY

To lock the assembly, a locking cap 22 is inserted over the end of the locking post 21. The leading chamfered edge 38 and chamfered edges 37*a,b,c* on ribs 36*a,b,c* or the chamfered edges 56*a,b,c,d* on the locking rings automatically center the locking rings 47*a,b,c,d.* When the end of the post 21 abuts against the key selector plate 45, the rings are then biased into the annular recesses 39*a,b,c,d* to retain the locking cap 22 in place.

To unlock the assembly, key 10 is inserted through the key selector plate 45. Beveled edges 9*a,b,c* of the fins 19*a,b,c* center the locking rings 47*a,b,c,d* to release the cap 22.

The ejector pin or piston 30 retracts as the key is forced inwardly during unlocking. This pin has multiple functions. The pin protects the system against dirt or ice and also deters picking of the lock. Furthermore, the piston 30 permits one hand unlocking of the assembly since once the key is inserted, the ejector pin 30 then forces the key out of the bore 28 while the locking cap 22 remains on the end of the key due to the biasing action of the springs 52*a,b,c,d.*

Although as few as one locking ring may be employed, the more locking rings that are provided the greater the integrity of the assembly. Each ring preferably grips the ribs of the locking post through an angle of 180°, although smaller gripping angles down to 90° are acceptable. If two rings are provided, with each gripping through an angle of 180°, a 360° surface retention angle may be obtained.

If a key selector plate 45 is loosely mounted, it can be rotated to cover the slots 35*a,b,c* of the post member 27 and thus further inhibit entry of dirt. If the plate 45 is securely mounted, the cap 22 may be rotated to cover slots 35*a,b,c.* In either event, before unlocking, the slots of the key selector plate must be aligned with the slots in the locking post.

It should be appreciated that with the locking assembly of this invention, a variety of key configurations can be obtained by changing the angles and number of fins on the key.

Cap 22 may be manufactured either by press fitting assembly or machining as a one piece assembly.

A less expensive system can be obtained by eliminating the center piston pin 30 although such a system will not have the automatic locking features or the weather protection inherent in the assembly which includes the piston pin 30.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A lock assembly comprising, a locking post having a first securing portion at one end, a longitudinal bore, at least one rib transverse to the longitudinal axis of and near the other end of the post, and at least one longitudinal slot in the locking post intersecting said at least one rib, a locking cap receivable over said other end of the post, a second securing portion on the locking cap, a key aperture in the cap, a locking means positioned in the locking cap and spring biased to engage said at least one rib of the locking post when said cap is received over said other end of the locking post, and in which said locking means comprises a locking ring having a central aperture through which said locking post may be received, said locking ring being biased by spring means into an eccentric position with respect to a central longitudinal axis of said locking post, a portion of said locking ring intersecting the locking post longitudinal slot.

2. A lock assembly comprising, a locking post having a first securing portion at one end, a longitudinal bore, at least one rib transverse to the longitudinal axis of and near the other end of the post, and at least one longitudinal slot in the locking post intersecting said at least one rib, a locking cap receivable over said other end of the post, a second securing portion on the locking cap, a key aperture in the cap, a locking means positioned in the locking cap and spring biased to engage said at least one rib of the locking post when said cap is received over said other end of the locking post, and in which said first securing means comprises a pin supported adjacent an open end of the longitudinal bore at said one end of the locking post.

3. A lock assembly comprising, a locking post having a first securing portion at one end, a longitudinal bore, at least one rib transverse to the longitudinal axis of and near the other end of the post, and at least one longitudinal slot in the locking post intersecting said at least one rib, a locking cap receivable over said other end of the post, a second securing portion on the locking cap, a key aperture in the cap, a locking means positioned in the locking cap and spring biased to engage said at least one rib of the locking post when said cap is received over said other end of the locking post, and in which said locking means and rib are circular, said locking means surrounds said rib, and engages the same around at least a 90° angle.

4. A locking assembly comprising, a locking post having a first securing portion at one end, a longitudinal bore, at least one rib transverse to the longitudinal axis of and near the other end of the post, and at least one longitudinal slot in the locking post intersecting said at least one rib, a locking cap receivable over said other end of the post, a second securing portion on the locking cap, a key aperture in the cap, a locking means positioned in the locking cap and spring biased to engage said at least one rib of the locking post when said cap is received over said other end of the locking post, and in which said locking means comprises a locking ring having a central aperture, said locking post rib being an annular member formed by annular recesses on either side thereof, the diameter of the locking ring central aperture being just large enough to fit over the locking post rib.

5. The lock assembly of claim 1 further comprising a key receivable through said locking cap key aperture and into said locking post longitudinal bore, and release means on the key for releasing the locking means engaging said at least one rib, said release means operable through the locking post longitudinal slot.

6. The lock assembly of claim 5 in which said key means comprises a radial fin slidable within said longitudinal slot, said longitudinal slot being open ended and running from said other end of the locking post inwardly to at least said one rib.

7. The lock assembly of claim 6 in which said fin has a beveled leading edge.

8. The lock assembly of claim 1 in which said locking post other end and at least one rib are both chamfered for automatic deflection of the locking means when the locking cap is received on the locking post.

9. The lock assembly of claim 1 in which said locking cap has a loosely mounted key selector plate adjacent the key aperture, said key selector plate having an aperture shaped to conform to a cross section of a key receivable therethrough.

10. The lock assembly of claim 1 in which at least two ribs and two locking means are provided.

11. The lock assembly of claim 1 in which a key having at least two radial fins is receivable through said locking cap key aperture and into said post longitudinal bore, said fins receivable in two longitudinal slots in the locking post and engageable to deflect at least two locking means.

12. The lock assembly of claim 2 in which a spring biased ejector pin is slideable within said locking post longitudinal bore.

13. The lock assembly of claim 12 in which a guide means is provided on the ejector pin for centering a key receivable in said longitudinal bore.

* * * * *